US006832942B2

(12) United States Patent
Kim

(10) Patent No.: US 6,832,942 B2
(45) Date of Patent: Dec. 21, 2004

(54) CRT AND FRAME ASSEMBLY THEREFOR

(75) Inventor: Yong Kun Kim, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 19 days.

(21) Appl. No.: 10/125,533

(22) Filed: Apr. 19, 2002

(65) Prior Publication Data

US 2002/0167259 A1 Nov. 14, 2002

(30) Foreign Application Priority Data

Apr. 21, 2001 (KR) ..... 2001-21592

(51) Int. Cl.[7] ..... H01J 9/14; H01J 29/07

(52) U.S. Cl. ..... 445/37; 445/30; 445/23; 445/47; 313/402; 313/404; 313/407

(58) Field of Search ..... 313/402–408; 445/30, 37, 23, 47

(56) References Cited

U.S. PATENT DOCUMENTS 4,286,189 A * 8/1981 Koizumi et al. ..... 313/402
5,681,197 A * 10/1997 Egami et al. ..... 445/30
6,084,342 A * 7/2000 Ragland, Jr. ..... 313/407
6,552,482 B2 * 4/2003 Ito et al. ..... 313/407
6,573,645 B1 * 6/2003 Bucher ..... 313/405

FOREIGN PATENT DOCUMENTS

JP 2000-067747 3/2000
JP 2000-215802 8/2000

* cited by examiner

*Primary Examiner*—Vip Patel
*Assistant Examiner*—Anthony Perry
(74) *Attorney, Agent, or Firm*—Fleshner & Kim, LLP

(57) ABSTRACT

A cathode ray tube is provided which includes a panel having a fluorescent surface formed on an inside surface thereof, a tension type shadow mask fitted to the panel with a gap formed therebetween, and a frame. The frame includes two main frames fixed to the tension type shadow mask under tension, and two subframes fixed respectively to ends of the two main frames. A distance between the two main frames between a center part or portion of the main frame and an edge part or portion. To assemble the frame assembly and the shadow mask, the main frames are compressed, the tension type shadow mask is welded thereto, and the compression applied to the main frames is then released. The invention improves a howling characteristic by reducing a vibratory length of the shadow mask and increasing a natural frequency of the center part or portion of the shadow mask.

3 Claims, 5 Drawing Sheets

CRT AND FRAME ASSEMBLY THEREFOR

BACKGROUND OF THE INVENTION

1. Field of the Invention

The invention relates to a cathode ray tube. More particularly, the invention relates to a shadow mask frame assembly of a cathode ray tube (CRT), in which a center part of the main frames is compressed more than corner parts in welding the shadow mask thereto.

2. Background of the Related Art

Referring to FIGS. 1 and 2, a related art CRT is shown which includes a panel 1 having a fluorescent surface 4 with fluorescent materials (i.e., red, green, and blue) coated on an inside surface thereof. A funnel 2 is welded to a rear of the panel 1 with Frit glass. An electron gun (not shown) is sealed in a neck 2*a* of the funnel 2. The electron gun emits, accelerates, and focuses electron beams 6 for forming three colors (i.e., red, green, and blue).

A shadow mask 3 for selecting a desired fluorescent material to illuminate is disposed adjacent to the fluorescent surface 4. A frame assembly 7 holds the shadow mask 3. Springs 8 fasten the frame assembly 7 to the panel, while stud pins 18 fixed to an inside surface of a skirt part la of the panel 1 hold the springs 8. An inner shield 9 is fastened to the frame assembly 7 and is sealed under a high vacuum. The inner shield 9 minimizes an influence of external geomagnetism during operation of the CRT.

The electron beams 6 from the electron gun (not shown) provided in the neck part 2*a* of the funnel 2 are projected onto the fluorescent surface 4 on the inside surface of the panel 1 by an anodic voltage applied to the CRT. The electron beams are deflected in upper, lower, left, or right directions by a deflection yoke 5 before the electron beams reach the fluorescent surface, to form an image. There are two, four, or six polar magnets 10 for controlling the paths of the electron beams 6 so that they land on the correct fluorescent material, thereby preventing poor color purity.

In fabrication of a tension type shadow mask assembly, in which tension is applied to the shadow mask 3, both ends of two main frames 7-1 are held fixed by subframes 7-2. The main frames 7-1 are then compressed, and the shadow mask 3 is welded to the main frames 7-1. The compression of the main frames 7 is then released, applying tension to the shadow mask 3.

Referring to FIGS. 2 and 3A, in a related art frame assembly, the shadow mask 3 is welded at ends 3*a*, 3*b* of the main frames 7-1 under tension. The frame assembly 7 with the shadow mask 3 attached thereto is then connected to the stud pins 18 on the panel 1 by springs 8 on an inside surface of the panel 1, to couple the frame assembly 7 with the panel 1.

To cope with howling, or a vibration of the shadow mask, in the related art, the main frames 7-1 are welded to the shadow mask 3 while the main frames 7-1 are compressed at a fixed load, as shown in FIG. 3B. The compression load is then released, putting the shadow mask under tension in a vertical direction, that is, in the direction of arrow A in FIGS. 1 and 3A. In this instance, the tension is configured to have a 'U' shaped distribution, so as to cope with howling by setting a range of vibration for the different frequency bands of, for example, an external vibration source of a speaker in a TV receiver.

However, though the related art CRT provides a counter measure for addressing howling, that is, applying tension to the shadow mask in a vertical direction to increase a natural frequency of the shadow mask, the natural frequency of the shadow mask in such a frame assembly decreases as a vertical length height) of the shadow mask increases following an increase in the size of the TV receiver. When the natural frequency drops, the shadow mask assembly vibrates even at low frequency sound received from the speaker in the TV receiver sash, and thus becomes susceptible to howling.

Since the longer the shadow mask, the lower the natural frequency of the shadow mask for the same amount of tension, in order to apply optimal tension to the shadow mask in a frame assembly to prevent howling, the natural frequency must be increased to apply tension favorable to avoiding howling. To apply the required tension to the shadow mask, the compression applied to the frame must be increased so as to produce greater deformation.

In order to compress the frame to greater deformation, since the frame deformation must be within a range of elastic deformation where the frame comes back to an original position when the compression is released, a yielding stress of the frame must be enhanced by heat treating the frame or by changing the material of the frame.

The related art shadow mask has a problem that the vibration range is wide because there is almost no rigidity difference between a center part and the corner parts of the shadow mask. Further, there is not a great variation in natural frequencies between the center part and the corner parts of the shadow mask, even if the tension distribution is configured to have a 'U' distribution in the related art frame assembly.

SUMMARY OF THE INVENTION

An object of the invention is to substantially solve at least one or more of the above problems and/or disadvantages in whole or in part and to provide at least the advantages described hereinafter.

Accordingly, the invention is directed to a shadow mask frame assembly in a CRT that substantially obviates at least one or more of the problems due to limitations and disadvantages of the related art.

Another object of the invention is to provide a shadow mask frame assembly in a CRT which can cope with a quality degradation of a center part of a shadow mask, the most susceptible part of the CRT to howling.

In order to achieve at least the above objects in whole or in part and in accordance with the purposes of the invention, as embodied and broadly described, a CRT according to the invention may include a panel having a fluorescent surface formed on an inside surface thereof, a tension type shadow mask fitted to the panel with a gap formed between the shadow mask and the panel, and a frame. The frame may include two main frames to which the tension type shadow mask is affixed under tension, and two subframes fixed to respective ends of the two main frames, wherein a distance between the two main frames increases from center part or portion of the main frames to an edge part or portion during assembly when the main frames are compressed, the tension type shadow mask is welded thereto, and the compression applied to the frames is released thereafter.

It is preferable that, when it is assumed that 'a' denotes a distance between the main frames before compression, and 'b' denotes a distance between the main frames where the main frames are compressed and the shadow mask is welded thereto, a compression change ratio '$R_c$' of the main frames at the center of the main frames satisfies the range expressed by equation (1) as follows:

$$3.0\% \leqq R_c = (a_c - b_c)/a_c * 100 \leqq 5.0\% \quad (1)$$

And, at a position approximately 90% from the center part of the main frames, the compression change ratio R satisfies the following range expressed by equation (2) as follows:

$$0.90\% \leqq R_{90\%} = (a_{90\%} - b_{90\%})/a_{90\%} * 100 \leqq 1.67\% \quad (2)$$

To further achieve at least the above objects in whole or in part and in accordance with the purposes of the invention, as embodied and broadly described, a CRT according to the invention may include a panel having a fluorescent surface, a shadow mask fitted to the panel with a gap formed therebetween, and a frame. The frame may include at least two main frames configured to be fixed to the shadow mask, and at least two subframes fixed respectively to ends of the main frames, wherein during assembly of the main frames and the shadow mask, the main frames are compressed such that a distance between the main frames at a center portion thereof is smaller than a distance between the main frames at an edge portion thereof.

To further achieve at least the above objects in whole or in part and in accordance with the purposes of the invention, as embodied and broadly described, a method of manufacturing a cathode ray tube comprising a panel having a fluorescent surface, a shadow mask fitted to the panel with a gap formed therebetween, and a frame including a pair of main frames and a pair of subframes fixed respectively to ends of the pair of subframes, according to the invention may include compressing the main frames such that a distance between the main frames at center portions of the main frames is smaller than a distance between the main frames at an edge portion of the main frames, welding the shadow mask to the main frames, and releasing the compression.

It is to be understood that both the foregoing general description and the following detailed description are exemplary and explanatory and are intended to provide further explanation of the invention as claimed.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements. The accompanying drawings, which are included to provide a further understanding of the invention and are incorporated in and constitute a part of this specification, illustrate embodiments of the invention and together with the description serve to explain the principles of the invention, wherein.

DETAILED DESCRIPTION OF THE PREFERRED EMBODIMENT

Reference will now be made in detail to the embodiments of the invention, examples of which are illustrated in the accompanying drawings.

Figure 1:
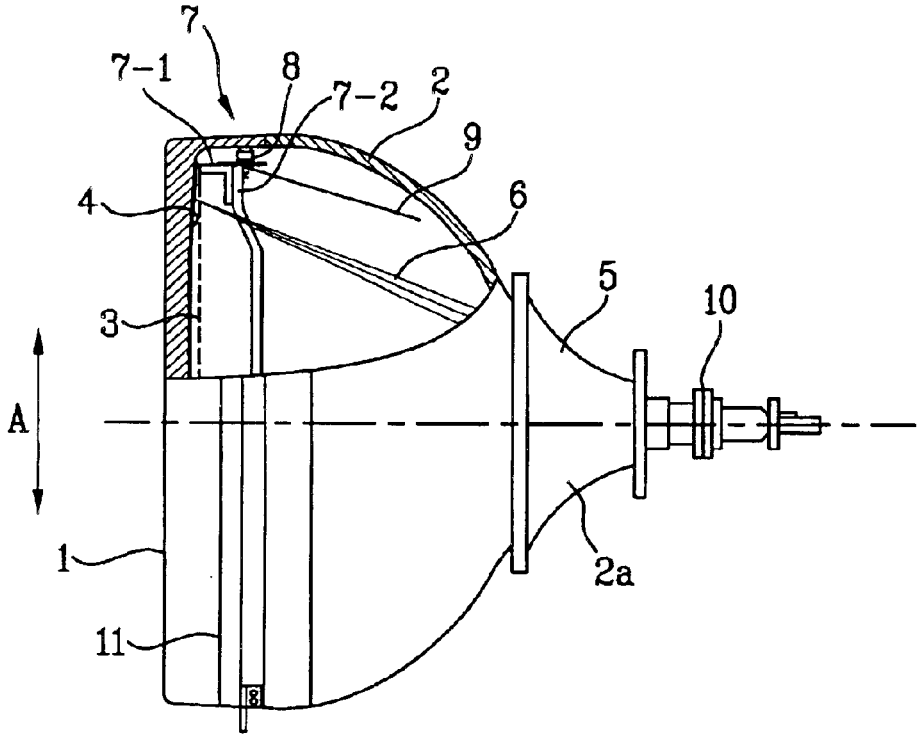
FIG.1 Related Art
FIG. 1 is a side view of a related art CRT, a portion of which is a cross section of the related art CRT.
Figure 2:
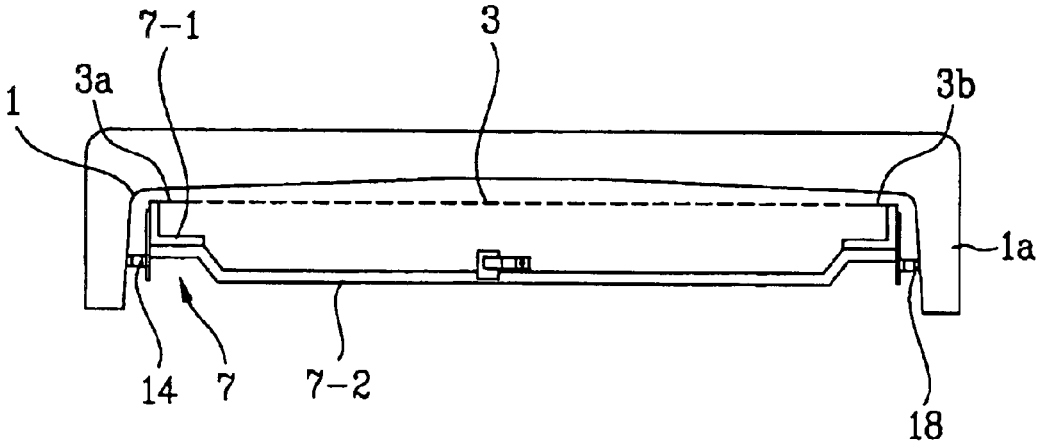
FIG.2 Related Art
FIG. 2 is a side view of a related art shadow mask fitted to a portion of a related art CRT.
Figure 3A:
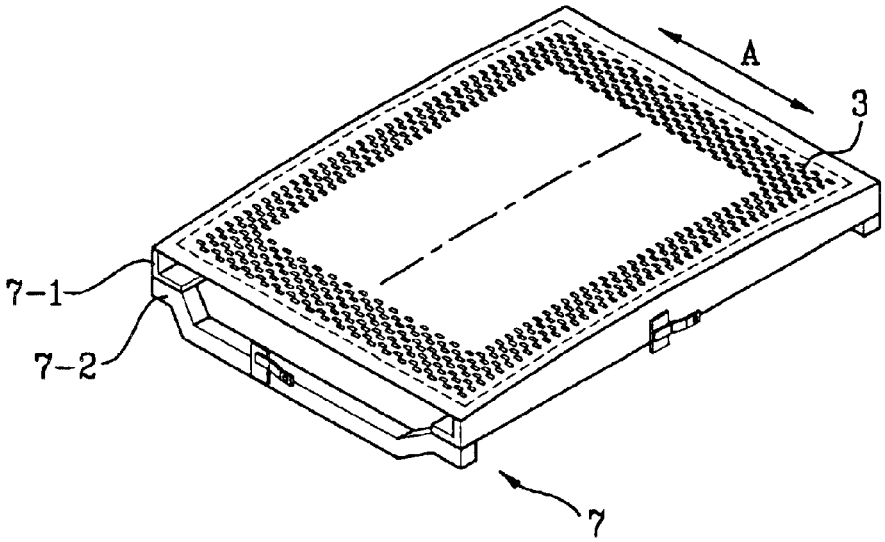
FIG.3A Related Art
FIG. 3A is a perspective view of a related art shadow mask assembly.
Figure 3B:
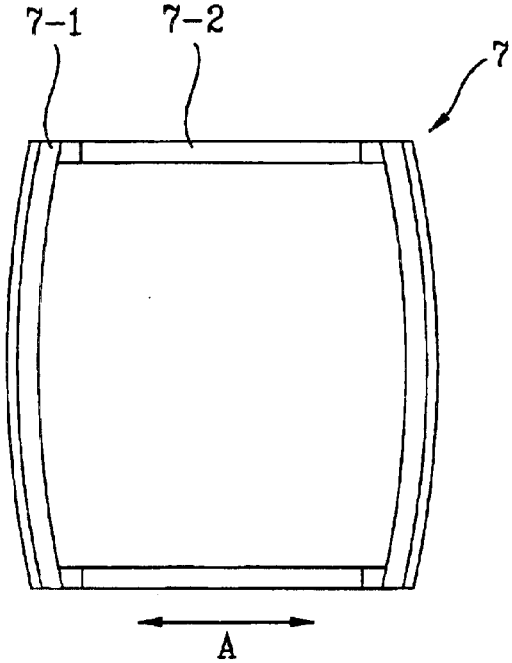
FIG.3B Related Art
FIG. 3B is a front view of a frame assembly of the shadow mask assembly of FIG. 3A.
Figure 4A:
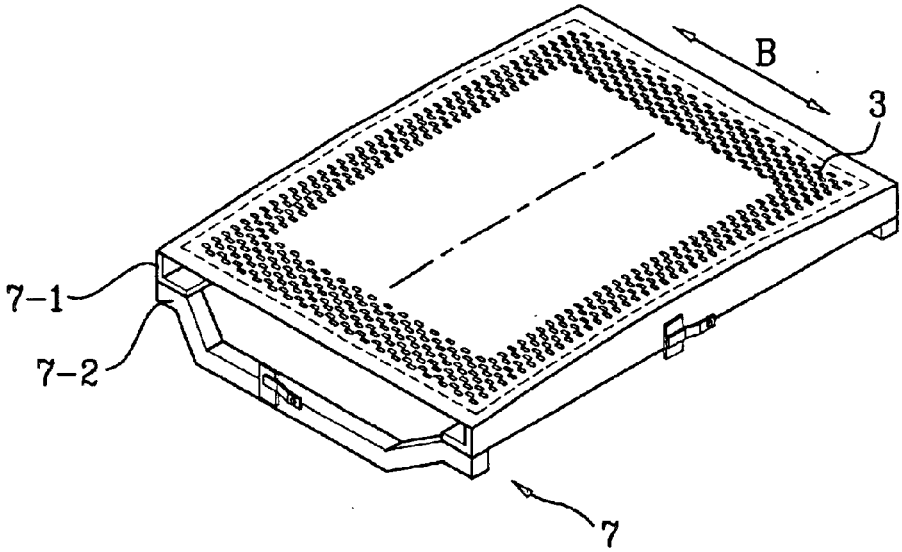
FIG. 4A is a perspective view of a shadow mask assembly in accordance with an embodiment of the invention.
Figure 4B:
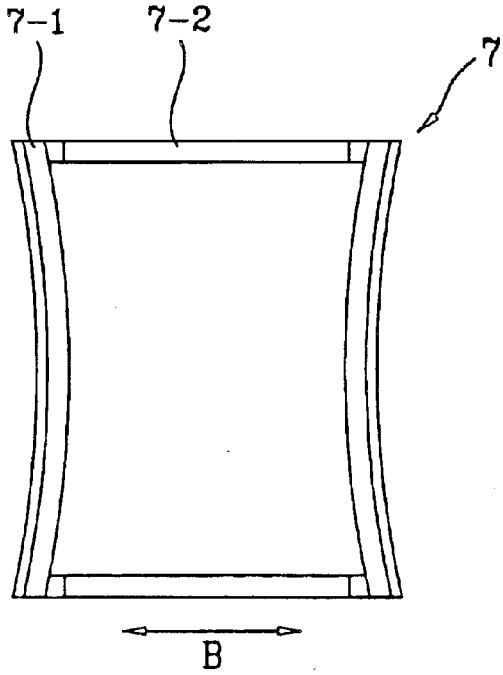
FIG. 4B is a front view of a frame assembly of the shadow mask assembly of FIG. 4A.
Figure 5A:
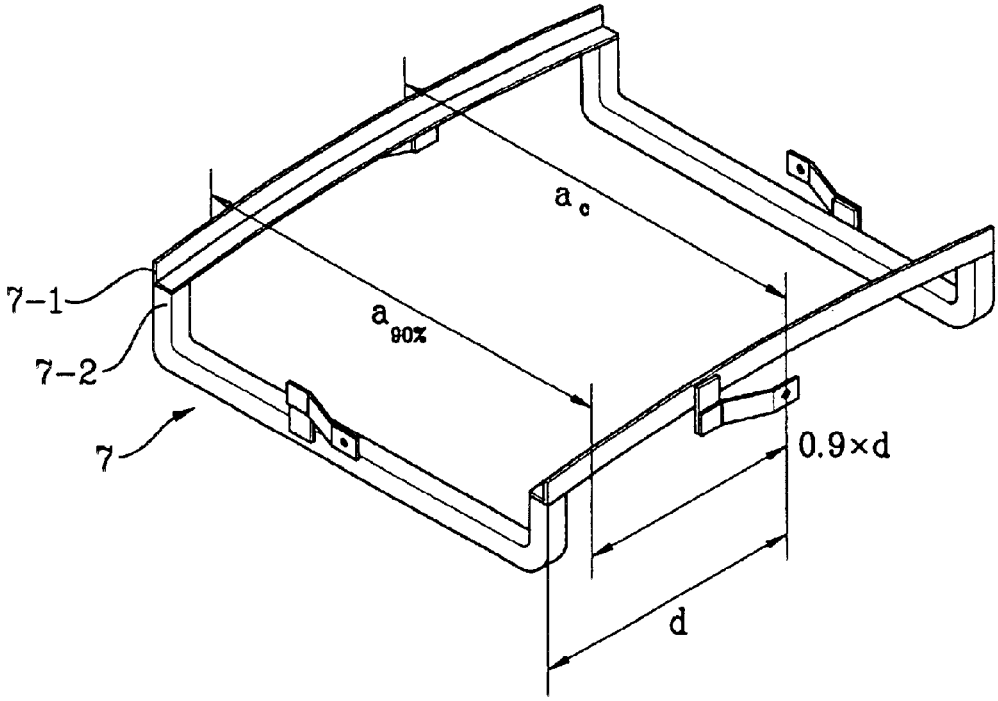
FIG. 5A is a perspective view of an individual frame with dimensions in accordance with an embodiment of the invention.
Figure 5B:
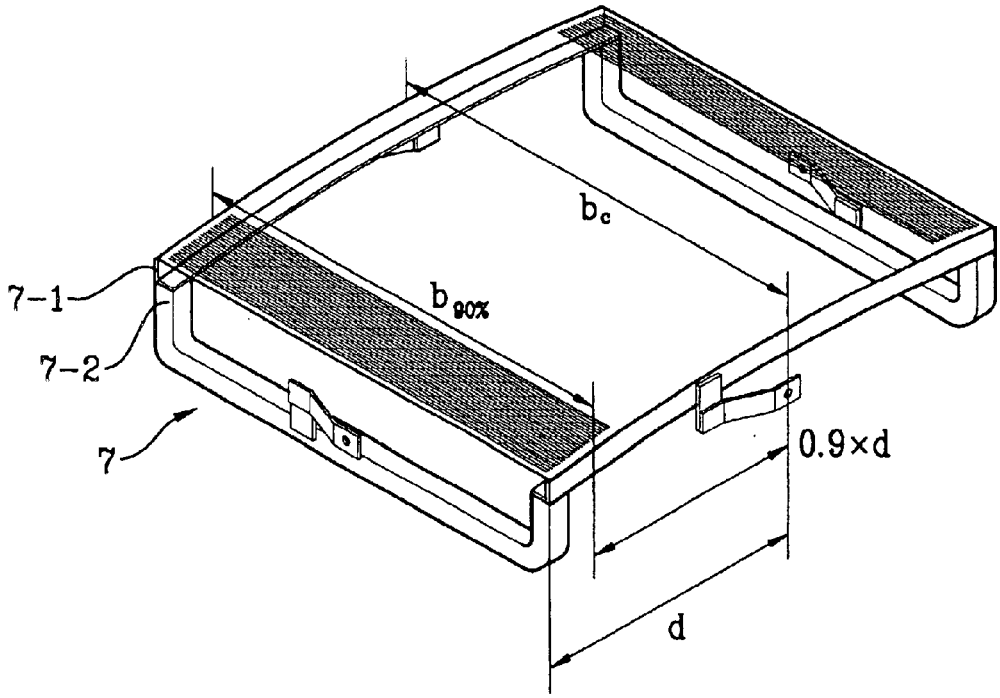
FIG. 5B is a perspective view of a frame in a shadow mask assembly with dimensions in accordance with an embodiment of the invention.
Figure 6:
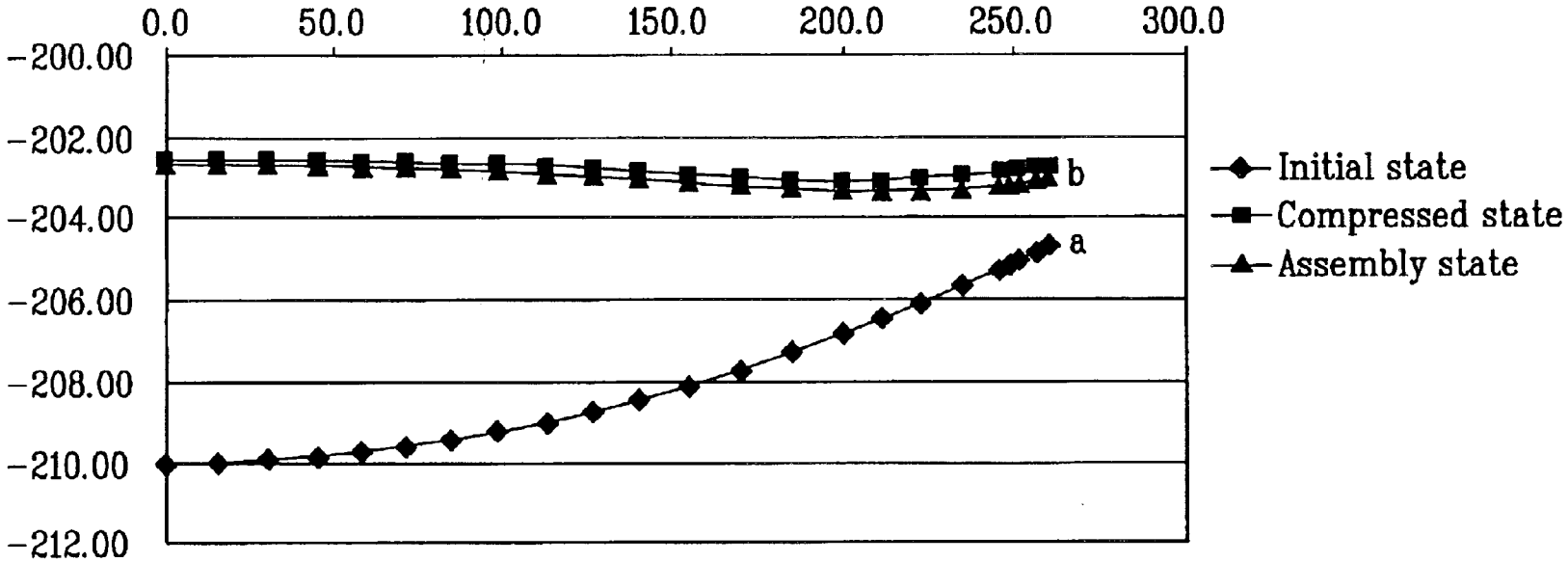
FIG. 6 is a graph showing a frame compression amount of the invention.

FIG. 4A shows a perspective view of a shadow mask assembly in accordance with an embodiment of the invention. Like the related art frame 7 of FIGS. 1–3B, the frame assembly 7 of the invention includes two main frames 7-1 and two subframes 7-2. The shadow mask 3 is welded to the two main frames 7-1 under tension, as discussed below.

Referring to FIGS. 4A, 4B, 5A, 5B and 6, the individual main frames 7-1 are compressed at an initial load, and then the shadow mask 3 is welded thereto. The compression is then released, which puts the shadow mask 3 in a state of tension in a vertical direction, that is, in the direction of arrow B in FIGS. 4A–4B. In this instance, the tension distribution of the shadow mask 3, which copes with externally applied vibration, is dependent on the amount of compression applied to the individual main frames. In accordance with the invention, the compression amount at a center part or portion of the shadow mask 3 is made greater than a compression amount at corner parts or portions of the shadow mask 3. The appropriate compression ratio is determined as follows.

It is assumed that 'a' denotes a distance between upper and lower main frames 7-1 before the shadow mask is welded to the main frames 7-1, and 'b' denotes a distance between the upper and lower main frames 7-1 in a state where the shadow masks is attached to the main frames. The shadow mask is assembled such that 'a'−'b' decreases between a center of the main frames 7-1 and the edges thereof Moreover, as the size of the CRT increases, more particularly, as the height increases, more compression is required for meeting the required tension distribution. Therefore, a ratio of the distance between individual main frames before compression to the difference after welding must fall within a fixed range.

In accordance with the invention, a compression amount of the main frames is configured to be greater at the center part or portion of the mainframe than at the corner parts or portions of the main frame when welding the shadow mask thereto. This increases a natural frequency of the center part or portion by reducing the area of the shadow mask which can vibrate because the size of the center part (a height of the shadow mask, 'L') of the shadow mask which actually vibrates is reduced, i.e., a no effect area of the shadow mask, which is part of the vibratory part of the shadow mask, is reduced by the difference between the corner part compression and the center part compression. This is accomplished without improving the yielding strengths of the main frames by changing the material of the mainframes, and without heat treating the frame assembly.

Equation (3) can be used to express the natural frequency of the shadow mask as follows:

$$f = \frac{1}{2(L)}\sqrt{P/\rho}, \quad (3)$$

where, f: a natural frequency of a string,

L: a height of an effective area of the shadow mask,

P: a tension on both ends of the string, and

ρ: mass per unit length.

That is, equation (3) expresses the relationship between the natural frequency of the string and the tension on both ends of the string, and the length of the string. It can be determined from equation (3) that, when it is assumed that tensions on both ends of the strings are the same, the longer the vibratory length, the lower the natural frequency, and vice versa. Therefore, to increase the natural frequency of the shadow mask, the length 'L' may be reduced, even if the tensions remain the same.

With reference to equation (3), the smaller the 'L', the actual length of vibration in the shadow mask, the higher the natural frequency of the shadow mask. Thus, the 'L' is reduced if the compression amount at a center part or portion of the shadow mask is greater than the compression amount at a side part or portion, increasing the natural frequency of the center part or portion of the shadow mask, and allowing it to cope with howling at the center part or portion of the shadow mask.

Moreover, as the size of the CRT is increased, the tension distribution is designed to be favorable to preventing howling in accordance with the CRT's respective size, particularly, in a vertical direction, and the tension at the center part or portion is made to have a value higher than the natural frequency of the frame assembly. On the other hand, if the tension of the center part or portion is reduced to a natural frequency of the frame assembly, the frame assembly and the shadow mask resonate, causing a greater displacement of the shadow mask, changing the path of the electron beams significantly, and resulting in howling as the electron beams can not land at a desired point on the fluorescent surface.

To solve this problem, and more particularly, to improve the tension distribution, the compression amount is designed to be proportional to a height of the frame. Accordingly, a ratio of a size of the individual main frames before being compressed to the compression amount can be expressed using equation (4) below:

$$R=(a-b)/a \quad (4)$$

Then, the range of the center part or portion of the main frames, can be expressed by equation (1) as follows:

$$3.0\% \leqq R_c=(a_c-b_c)/a_c*100 \leqq 5.0\% \quad (1),$$

where, R: a ratio of a height of the main frames before compression to the compression amount, a: a compression amount, b: a height of the main frames before being compressed.

And, in the case of an edge part or portion of the main frames, particularly, at a position approximately 90% from the center part or portion of the main frames to the edge portion, the range can be expressed by equation (2) below:

$$0.90\% \leqq R_{90\%}=(a_{90\%}-b_{90\%})a_{90\%}*100 \leqq 1.67\% \quad (2).$$

As the tension distribution of the subframes, which support the main frames, is wide and the natural frequency is adequate within the range of 90% and over, the 90% from the center part or portion to the edge portion is used.

While the related art frame assembly has the problem of having a wide range of vibration of the shadow mask due to the fact that there is almost no rigidity difference between the center part or portion and the corner parts or portions of the shadow mask, and there is no significant difference in natural frequencies between the center part or portion and the corner parts or portions, even if the frame assembly is compressed forming a 'U' shaped tension distribution, the frame assembly according to the invention has a certain level of rigidity difference between the center part or portion and the corner part or portions of the frame assembly, which provides a sharp natural frequency difference between the center part or portion and the corner parts or portions, thereby reducing howling, that is, vibration of the shadow mask.

As has been explained, the invention can improve howling characteristic of a shadow mask of a CRT by compressing a center part or portion of the shadow mask frame assembly more than the corner parts or portions of the main frames when welding the shadow mask to the main frames. The invention reduces the vibratory part size (a height of the shadow mask, 'L' value) of the shadow mask and increases the natural frequency of the center part or portion of the shadow mask without changing the properties of the frame assembly, that is, for example, without changing the material of the frame assembly or strengthening the yielding strength of the frame assembly.

By designing the frame to have a certain level of rigidity difference between the center part or portion and the corner parts or portions of the frame assembly, in order to make the natural frequency difference between the center part or portion and the corner parts or portions sharper than the related art, even if a 'U' shaped tension distribution is used, the vibration range is narrowed, resulting in reduced howling, that is, vibration of the shadow mask.

It will be apparent to those skilled in the art that various modifications and variations can be made in the frame assembly for a CRT according to the invention without departing from the spirit or scope of the invention. Thus, it is intended that the present invention cover the modifications and variations of this invention provided they come within the scope of the appended claims and their equivalents.

The foregoing embodiments and advantages are merely exemplary and are not to be construed as limiting the invention. The present teaching can be readily applied to other types of apparatuses. The description of the invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A method of manufacturing a cathode ray tube comprising a panel having a fluorescent surface, a shadow mask fitted to the panel with a gap formed therebetween, and a frame including at least two main frames and at least two subframes fixed respectively to ends of the main frames, the method comprising:

compressing the main frames such that a distance between the main frames at a center portion thereof is smaller than a distance between the main frames at an end portion thereof;

welding the shadow mask to the main frames; and releasing the compression on the main frames, wherein, when it is assumed that 'a' denotes a distance between the main frames before being compressed, and 'b' denotes a distance between the main frames during assembly of the shadow mask and the main frames, a compression change ratio 'R' of the main frames at a center portion thereof satisfies the following equation:

$$3.0\% \leqq R=(a-b)/a^* 100 \leqq 5.0\%.$$

2. The method as claimed in claim 1, wherein, when it is assumed that 'a' denotes a distance between the main frames before being compressed, and 'b' denotes a distance between the main frames during assembly of the shadow mask and the main frames, a compression change ratio 'R' of the main frames at a position approximately 90% from the center portion thereof satisfies the following equation:

$$0.90\% \leqq R=(a-b)/a^* 100 \leqq 1.67\%.$$

3. A method of manufacturing a cathode ray tube comprising a panel having a fluorescent surface, a shadow mask fitted to the panel with a gap formed therebetween, and a frame including at least two main frames and at least two subframes fixed respectively to ends of the main frames, the method comprising:

compressing the main frames such that a distance between the main frames at a center portion thereof is smaller than a distance between the main frames at an end portion thereof;

welding the shadow mask to the main frames; and releasing the compression on the main frames, wherein, when it is assumed that 'a' denotes a distance between the main frames before being compressed, and 'b' denotes a distance between the main frames during assembly of the shadow mask and the main frames, a compression change ratio 'R' of the main frames at a position approximately 90% from the center portion thereof satisfies the following equation:

$$0.90\% \leqq R=(a-b)/a^* 100 \leqq 1.67\%.$$

* * * * *